US006102525A

United States Patent [19]

Jonsson

[11] Patent Number: 6,102,525

[45] Date of Patent: Aug. 15, 2000

[54] METHOD AND APPARATUS FOR CONTROLLING THE PRINT IMAGE DENSITY IN A DIRECT ELECTROSTATIC PRINTING APPARATUS

[75] Inventor: Tomas Jonsson, Mölndal, Sweden

[73] Assignee: Array Printers AB, Vastra Frolunda, Sweden

[21] Appl. No.: 09/044,479

[22] Filed: Mar. 19, 1998

[51] Int. Cl.[7] ..... B41J 2/06

[52] U.S. Cl. ..... 347/55

[58] Field of Search ..... 347/55, 12, 40, 347/120, 124, 112; 399/266, 270, 271, 289, 290, 291

[56] References Cited

U.S. PATENT DOCUMENTS

| | | | |
|---|---|---|---|
| 3,566,786 | 3/1971 | Kaufer et al. . | |
| 3,689,935 | 9/1972 | Pressman et al. . | |
| 3,779,166 | 12/1973 | Pressman et al. . | |
| 3,815,145 | 6/1974 | Tisch et al. | 347/123 |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |

OTHER PUBLICATIONS

E. Bassous, et al., "The Fabrication of High Precision Nozzles by the Anisotropic Etching of (100) Silicon", *J. Electrochem. Soc.: Solid–State Science and Technology,* vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies,* 1994, pp. 311–313.

"The Best of Both Worlds," Brochure of Toner Jet® by Array Printers, *The Best of Both Worlds,* 1990.

*Primary Examiner*—Sandra Brase
*Assistant Examiner*—Hoan Tran
*Attorney, Agent, or Firm*—Knobbe, Martens, Olson & Bear, LLP

[57] ABSTRACT

A direct electrostatic printing device and method for printing an image to an information carrier with increased density harmonization. By continuously keeping track of the amount of pigment particles each aperture has available and thereafter using this information and the desired print density to control the control electrodes of the individual apertures, a harmonization of the printed density from different apertures is attained.

18 Claims, 11 Drawing Sheets

U.S. PATENT DOCUMENTS 4,263,601 4/1981 Nishimura et al. .
4,274,100 6/1981 Pond .
4,353,080 10/1982 Cross .
4,382,263 5/1983 Fischbeck et al. ..... 347/55
4,384,296 5/1983 Torpey .
4,386,358 5/1983 Fischbeck .
4,470,056 9/1984 Galetto et al. .
4,478,510 10/1984 Fujii et al. .
4,491,794 1/1985 Daley et al. .
4,491,855 1/1985 Fujii et al. .
4,498,090 2/1985 Honda et al. .
4,511,907 4/1985 Fukuchi .
4,525,727 6/1985 Kohashi et al. .
4,571,601 2/1986 Teshima .
4,610,532 9/1986 De Schamphelaere et al. ..... 399/58
4,611,905 9/1986 De Schamphelaere et al. ..... 399/58
4,675,703 6/1987 Fotland .
4,717,926 1/1988 Hotomi .
4,743,926 5/1988 Schmidlin et al. .
4,748,453 5/1988 Lin et al. .
4,814,796 3/1989 Schmidlin .
4,831,394 5/1989 Ochiai et al. .
4,860,036 8/1989 Schmidlin .
4,896,184 1/1990 Kamitamari et al. ..... 399/29
4,903,050 2/1990 Schmidlin ..... 347/55
4,912,489 3/1990 Schmidlin .
5,028,812 7/1991 Bartky .
5,036,341 7/1991 Larsson .
5,038,159 8/1991 Schmidlin et al. .
5,057,855 10/1991 Damouth .
5,072,235 12/1991 Slowik et al. .
5,083,137 1/1992 Badyal et al. .
5,095,322 3/1992 Fletcher ..... 347/55
5,121,144 6/1992 Larson et al. .
5,128,695 7/1992 Maeda .
5,148,595 9/1992 Doggett et al. .
5,170,185 12/1992 Takemura et al. .
5,181,050 1/1993 Bibl et al. .
5,204,696 4/1993 Schmidlin et al. .
5,204,697 4/1993 Schmidlin .
5,214,451 5/1993 Schmidlin et al. .
5,229,794 7/1993 Honman et al. .
5,235,354 8/1993 Larson ..... 347/124
5,237,346 8/1993 Da Costa et al. .
5,256,246 10/1993 Kitamura .
5,257,045 10/1993 Bergen et al. .
5,270,729 12/1993 Stearns .
5,274,401 12/1993 Doggett et al. .
5,307,092 4/1994 Larson .
5,329,307 7/1994 Takemura et al. ..... 347/151
5,374,949 12/1994 Wada et al. ..... 114/264
5,386,225 1/1995 Shibata .
5,402,158 3/1995 Larson .
5,414,500 5/1995 Furukawa ..... 399/285
5,446,478 8/1995 Larson ..... 347/158
5,450,115 9/1995 Bergen et al. .
5,453,768 9/1995 Schmidlin ..... 347/158
5,473,352 12/1995 Ishida .
5,477,246 12/1995 Hirabayashi et al. .
5,477,250 12/1995 Larson ..... 347/55
5,506,666 4/1996 Masuda et al. .
5,508,723 4/1996 Maeda ..... 347/55
5,515,084 5/1996 Larson .
5,526,029 6/1996 Larson et al. ..... 347/55
5,558,969 9/1996 Uyttendaele et al. ..... 430/124
5,559,586 9/1996 Wada ..... 347/55
5,600,355 2/1997 Wada ..... 347/55
5,614,932 3/1997 Kagayama ..... 348/55
5,617,129 4/1997 Chizuk, Jr. et al. .
5,625,392 4/1997 Maeda .
5,640,185 6/1997 Kagayama .
5,650,809 7/1997 Kitamura .
5,666,147 9/1997 Larson .
5,677,717 10/1997 Ohashi ..... 347/69
5,708,464 1/1998 Desie ..... 347/55
5,774,159 6/1998 Larson ..... 347/151
5,801,729 9/1998 Kitamura et al. ..... 347/55
5,805,185 9/1998 Kondo ..... 347/55
5,818,480 10/1998 Bern et al. ..... 347/55
5,818,490 10/1998 Larson ..... 347/151
5,847,733 12/1998 Bern ..... 399/271

METHOD AND APPARATUS FOR CONTROLLING THE PRINT IMAGE DENSITY IN A DIRECT ELECTROSTATIC PRINTING APPARATUS

FIELD OF THE INVENTION

The present invention relates to direct electrostatic printing methods in which charged toner particles are transported under control from a particle source in accordance with an image information to form a toner image used in a copier, a printer, a plotter, a facsimile, or the like.

BACKGROUND TO THE INVENTION

According to a direct electrostatic printing method, such as that disclosed in U.S. Pat. No. 5,036,341, a background electric field is produced between a developer sleeve and a back electrode to enable the transport of charged toner particles therebetween. A printhead structure, such as an electrode matrix provided with a plurality of selectable apertures, is interposed in the background electric field and connected to a control unit which converts an image information into a pattern of electrostatic control fields which selectively open or close the apertures, thereby permitting or restricting the transport of toner particles from the developer sleeve. The modulated stream of toner particles allowed to pass through opened apertures impinges upon an information carrier, such as paper, conveyed between the printhead structure and the back electrode, to form a visible image.

According to such a method, each single aperture is utilized to address a specific dot position of the image in a transverse direction, i.e. perpendicular to paper motion. Thus, the transversal print addressability is limited by the density of apertures through the printhead structure. For instance, a print addressability of 300 dpi requires a printhead structure having 300 apertures per inch in a transversal direction.

A new concept of direct electrostatic printing, hereinafter referred to as dot deflection control (DDC), was introduced in U.S. patent application Ser. No. 08/621,074. According to the DDC method each single aperture is used to address several dot positions on an information carrier by controlling not only the transport of toner particles through the aperture, but also their transport trajectory toward a paper, and thereby the location of the obtained dot. The DDC method increases the print addressability without requiring a larger number of apertures in the printhead structure. This is achieved by providing the printhead structure with at least two sets of deflection electrodes connected to variable deflection voltages which, during each print cycle, sequentially modify the symmetry of the electrostatic control fields to deflect the modulated stream of toner particles in predetermined deflection directions.

For instance, a DDC method performing three deflection steps per print cycle, provides a print addressability of 600 dpi utilizing a printhead structure having 200 apertures per inch.

An improved DDC method, disclosed in U.S. patent application Ser. No. 08/759,481, provides a simultaneous dot size and dot position control. This later method utilizes the deflection electrodes to influence the convergence of the modulated stream of toner particles thus controlling the dot size. According to the method, each aperture is surrounded by two deflection electrodes connected to a respective deflection voltage D1, D2, such that the electrode field generated by the control electrodes remains substantially symmetrical as long as both deflection voltages D1, D2 have the same amplitude. The amplitudes of D1 and D2 are modulated to apply converging forces on toner to obtain smaller dots. The dot position is simultaneously controlled by modulating the amplitude difference between D1 and D2. Utilizing this improved method enables 60 $\mu$m dots to be obtained utilizing 160 $\mu$m apertures.

With or without DDC in direct electrostatic printing methods a plurality of apertures, each surrounded by a control electrode, are preferably arranged in parallel rows extending transversally across the print zone, i.e. at a right angle to the motion of the image receiving medium. As a pixel position on the image receiving medium passes beneath a corresponding aperture, the control electrode associated with this aperture is set on a print potential allowing the transport of toner particles through the aperture to form a toner dot at that pixel position. Accordingly, transverse image lines can be printed by simultaneously activating several apertures of the same aperture row.

However, it can be considered a drawback of current direct electrostatic printing methods that the behaviour of different apertures can vary and that also a perceived behaviour of individual apertures can vary resulting in somewhat different perceived image density for the same desired image density.

SUMMARY OF THE INVENTION

An object of the present invention is to provide a method of and device for harmonizing the behaviour of different apertures in direct electrostatic printing methods.

A further object of the present invention is to provide a method of direct electrostatic printing which temporally harmonizes the behaviour of individual apertures.

Still a further object of the present invention is to provide a method of and a device for harmonizing a perceived image density with a desired image density in direct electrostatic printing methods.

Yet a further object of the present invention is to provide a method of and a device for decreasing the need for an even pigment particle supply to the apertures in direct electrostatic printing methods.

Another object of the present invention is to provide a method of and device for reducing or eliminating perceived uneven image density in direct electrostatic printing methods.

Still another object of the present invention is to provide a method of and a device for trajecting a predetermined, within a predetermined margin, amount of toner/pigment particles to predetermined positions in view of an image which is to be printed.

Yet another object of the present invention is to provide a method of and a device for for reducing or eliminating perceived uneven image density in direct electrostatic printing methods due to an uneven behaviour of the apertures.

Said objects are achieved according to the invention by providing a direct electrostatic printing device and method for printing an image to an information carrier with increased density harmonization. This is attained by measuring the behaviour of the apertures and subsequently adjusting the control parameters of at least the diverging apertures. The measurement of the behaviour of the apertures is suitably performed by scanning a known print sample with a predetermined density. The scanned values are inverted around a predetermined value for which no compensation is done to create a compensation function. At least the apertures which have a behaviour which diverges from a predetermined behaviour are compensated according to the compensation function, thereby enabling an increased density harmonization. The compensation function can preferably be signal processed by, for example, a low pass filtering.

Said objects are also achieved according to the invention by providing a direct electrostatic printing device including a pigment particle source, a voltage source, a printhead structure, and a control unit. The pigment particle source provides pigment particles. An image receiving member and the printhead structure move relative to each other during printing. The image receiving member has a first face and a second face. The printhead structure is placed in between the pigment particle source and the first face of the image receiving member. The voltage source is connected to the pigment particle source and the back electrode thereby creating an electrical field for transport of pigment particles from the pigment particle source toward the first face of the image receiving member. The printhead structure includes control electrodes connected to the control unit to thereby selectively open or close apertures through the printhead structure to permit or restrict the transport of pigment particles to thereby enable the formation of a pigment image on the first face of the image receiving member. According one aspect of the invention the control unit controls the control electrodes of the apertures in such a way as to compensate for a difference in behaviour of the individual apertures during transport of pigment particles. This enables a percepted uniform printed image density across the apertures for a specific desired image density.

According to certain embodiments the control unit controls the selective opening and closing of each aperture by means of the control electrodes to thereby compensate for a difference in behaviour of the individual apertures by enabling transport of a within a region predetermined amount of pigment particles through each individual aperture or group of apertures for a specific desired image density. I some embodiments the control unit controls a voltage potential of each control electrode or group of control electrodes during the selective opening and closing of each aperture to thereby compensate for a difference in behaviour of the individual apertures by enabling transport of a within a region predetermined amount of pigment particles through each individual aperture or group of apertures for a specific desired image density. In other embodiments the control unit controls the selective opening and closing of each aperture by means of the control electrodes in combination with the control of a voltage potential of each control electrode or group of control electrodes during the selective opening and closing of each aperture to thereby compensate for a difference in behaviour of the individual apertures by enabling transport of a within a region predetermined amount of pigment particles through each individual aperture or group of apertures for a specific desired image density.

It is preferable that the control unit compensates the control of the control electrodes in relation to a reference value. It is even advantageous that the control unit compensates the control of the control electrodes in relation to a reference value of each aperture which indicates the behaviour of each of the individual apertures or group of apertures. Further it is preferable that the reference values are associated with a measurement of the behaviour of the apertures. The measurement can be an optical measurement of uncompensated printed image density. In such cases it is preferable that the electrostatic printing device further comprises an optical measurement means for the optical measurement of uncompensated printed image density. If not, then it is preferable that the electrostatic printing device further comprises input means for inputting the optically measured uncompensated printed image density. The compensation can preferably be inversely proportional to the measured optical image density. The measurement can also be filtered to create the reference values. If so then the measurement is preferably low-pass filtered.

The printhead structure can include deflection electrodes connected to the control unit for controlling the deflection of pigment particles in transport to thereby be able to deflect pigment particles against predetermined locations on the first face of the image receiving member by means of predetermined deflection voltages in view of the image which is to be printed.

The image receiving member can be an information carrier. The image receiving member can be a transfer belt comprised in the direct electrostatic printing device where the transfer belt is positioned at a predetermined distance from the printhead structure, the transfer belt being substantially of uniform thickness, whereby a pigment image is subsequently transferred to an information carrier. The transfer belt can suitably be supported by at least one holding element arranged on the side of the second face of the transfer belt adjacent to the print station. In some embodiments the first face of the image receiving member, the transfer belt, is substantially evenly coated with a layer of bouncing reduction agent thus providing a surface on the first face of the image receiving member that the pigment particles transported through the print head structure substantially adhere to substantially without bouncing. The image printing device can suitably further comprise a transfuser having heating means and pressurising means for transferring a pigment image on the surface of the first face of the image receiving member to an information carrier by locally applying heat and pressure to the information carrier and the pigment image by the heating means and pressurising means and thereby transferring the pigment image to the information carrier.

In some embodiments the image printing device is capable of printing color images and therefore preferably includes four pigment particle sources. The printing device suitably includes at least two pigment particle sources with corresponding control electrodes and apertures on and in at least one printhead structure. The image printing device can include four pigment particle sources with corresponding control electrodes and apertures on and in at least one printhead structure.

Said objects are also achieved according to the invention by a method for printing an image to an information carrier. The method comprises a number of steps. In a first step pigment particles are provided from a pigment particle source. In a second step an image receiving member and a printhead structure are moved relative to each other during printing. In a third step an electrical field is created for transporting pigment particles from the pigment particle source toward the first face of the image receiving member. In a fourth step apertures through a printhead structure are selectively opened or closed to permit or restrict the transporting of pigment particles to thereby enable the formation of a pigment image on the first face of the image receiving member. And in a final sixth step controlling control electrodes of the apertures in such a way as to compensate for a difference in behaviour of the individual apertures during transport of pigment particles thereby enabling a percepted uniform printed image density across the apertures for a specific desired image density.

Further variations of the method according to previously described enhancements are possible in view of the application of the invention.

Said objects are also achieved according to the invention by providing a direct electrostatic printing device and method for printing an image to an information carrier with improved harmonization of the printed density from a plurality of rows of apertures. The harmonization of the printed density from apertures from different rows is accomplished by an improved method of controlling the amount of pigment particles transported through the apertures of each row. The method takes into account which row the aperture belongs to and how the rows are positioned in relationship to the pigment particle feed.

Said objects are also achieved according to the invention by providing a direct electrostatic printing device including a pigment particle source, a voltage source, a printhead structure, and a control unit. The pigment particle source provides pigment particles. An image receiving member and the printhead structure move relative to each other during printing. The image receiving member has a first face and a second face. The printhead structure is placed in between the pigment particle source and the first face of the image receiving member. The voltage source is connected to the pigment particle source and the back electrode to thereby create an electrical field for transport of pigment particles from the pigment particle source toward the first face of the image receiving member. The printhead structure includes control electrodes connected to the control unit to thereby selectively open or close apertures through the printhead structure to permit or restrict the transport of pigment particles to thereby enable the formation of a pigment image on the first face of the image receiving member. The apertures are aligned in at least two rows in a direction mainly perpendicular to the relative movement between the image receiving member and the printhead structure. According to the invention the control unit controls an amount of pigment particles transported through the apertures of each row of apertures by means information of the relative positioning of the rows in such a way as to thereby enable a harmonization of a possible aquired printed image density printed by the at least two rows of apertures.

Preferably the control unit controls the control electrodes to thereby individually control the amount of pigment particles transported through the apertures of each row of apertures. Suitably the control unit controls the selective opening and closing of the apertures of each row to thereby control the amount of pigment particles transported through the apertures of each row of apertures. In some embodiments the control unit controls the selective opening and closing of the control electrodes in such a way that the apertures of the row situated upstream in relation to the pigment particle delivery, are open a shorter time than the apertures of the row or rows which are situated downstream in relation to the pigment particle delivery, to thereby control the amount of pigment particles transported through the apertures of each row of apertures. In other embodiments the control unit controls a voltage potential of the control electrodes of each row of apertures during the respective selective opening and closing of the apertures to thereby control the amount of pigment particles transported through the apertures of each row of apertures. In still further embodiments the control unit controls the selective opening and closing of the apertures of each row and a voltage potential of the control electrodes of each row of apertures during the respective selective opening and closing of the apertures to thereby control the amount of pigment particles transported through the apertures of each row of apertures.

In some embodiments pigment particles are transported through apertures of one row at a time and in these embodiments the control unit controls the voltage source differently for each row thereby varying the electrical field for transport of pigment particles in such a way that the amount of pigment particles transported through the apertures of each row of apertures is controlled.

Preferably the apertures in the different rows are interlaced.

Further variants are possible as disclosed above.

Said objects are also achieved according to the invention by a method for printing an image to an information carrier. The method comprises a number of steps. In a first step pigment particles are provided from a pigment particle source. In a second step an image receiving member and a printhead structure are moved relative to each other during printing. In a third step an electrical field is created for transporting pigment particles from the pigment particle source toward the first face of the image receiving member. In a fourth step apertures through a printhead structure are selectively opened or closed to permit or restrict the transporting of pigment particles to thereby enable the formation of a pigment image on the first face of the image receiving member, the apertures being aligned in at least two rows in a direction mainly perpendicular to the relative movement between the image receiving member and the printhead structure; nominally aligned with a dot matrix. And in a final sixth step controlling an amount of pigment particles transported through the apertures of each row of apertures in such a way as to harmonize an amount of available pigment particles to each row of apertures to thereby enable a harmonization of a possible aquired printed image density printed by the at least two rows of apertures.

Further variations of the method according to previously described enhancements are possible in view of the application of the invention.

Said objects are also achieved according to the invention by providing a direct electrostatic printing device and method for printing an image to an information carrier with increased density harmonization. By continuously keeping track of the amount of pigment particles each aperture has available and thereafter using this information and the desired print density to control the control electrodes of the individual apertures, a harmonization of the printed density from different apertures is attained.

Said objects are also achieved according to the invention by providing a direct electrostatic printing device including a pigment particle source, a voltage source, a printhead structure, and a control unit. The pigment particle source provides pigment particles. An image receiving member and the printhead structure move relative to each other during printing. The image receiving member has a first face and a second face. The printhead structure is placed in between the pigment particle source and the first face of the image receiving member. The voltage source is connected to the pigment particle source and the back electrode to thereby create an electrical field for transport of pigment particles from the pigment particle source toward the first face of the image receiving member. The printhead structure includes control electrodes connected to the control unit to thereby selectively open or close apertures through the printhead structure to permit or restrict the transport of pigment particles to thereby enable the formation of a pigment image on the first face of the image receiving member. According to one aspect of the invention the control unit controls the control electrodes of the apertures in view of an available amount of pigment particles to the apertures in relationship to the image to be printed to thereby harmonize a printed image density in view of a desired image density.

Preferably the control unit controls the control electrodes of the apertures in view of an available amount of pigment particles to the apertures in relationship to the image to be printed to thereby harmonize a printed dot density of a dot to be printed on an edge of a density variation feature in relation to a printed dot density of a dot to be printed within the feature, both with a same desired dot density.

Suitably the control unit determines the amount of available pigment particles by continuously updating a register for each aperture or a group of apertures, by subtraction of pigment particle usage from refill rate of pigment particles. The determination is preferably done in relation to the pigment particle pickup area from the pigment particle source for each aperture or group of apertures.

In one embodiment the control unit controls the selective opening and closing of the apertures such that, for the same desired dot density, the opening time is longer when printing a dot when the available amount of pigment particles for the aperture in question is low, than when printing a dot when the available amount of pigment particles for the aperture in question is high.

In some embodiments the control unit controls a voltage potential of the control electrodes of the apertures, during the selective opening and closing of the apertures, such that, for the same desired dot density, an amount of delivered pigment particles when printing a dot when the available amount of pigment particles for the aperture in question is low, is mainly the same as when printing a dot when the available amount of pigment particles for the aperture in question is high.

In some embodiments the control unit in combination controls the selective length of opening of the apertures and a voltage potential of the control electrodes of the apertures during the selective opening such that, for the same desired dot density, the opening time and voltage potential of the control electrodes is adjusted in such a way that an amount of delivered pigment particles when printing a dot when the available amount of pigment particles for the aperture in question is low, is mainly the same as when printing a dot when the available amount of pigment particles for the aperture in question is high.

Preferably the control unit controls the control electrodes of the apertures such that an amount of pigment particles delivered to a dot on an edge of a feature is mainly the same as an amount of pigment particles delivered to a dot, with the same desired dot density, within the feature.

Further variants are possible according to the invention as previously disclosed.

Said objects are also achieved according to the invention by a method for printing an image to an information carrier. The method comprises a number of steps. In a first step pigment particles are provided from a pigment particle source. In a second step an image receiving member and a printhead structure are moved relative to each other during printing. In a third step an electrical field is created for transporting pigment particles from the pigment particle source toward the first face of the image receiving member. In a fourth step apertures through a printhead structure are selectively opened or closed to permit or restrict the transporting of pigment particles to thereby enable the formation of a pigment image on the first face of the image receiving member. And in a final sixth step controlling control electrodes of the apertures in view of an available amount of pigment particles to the apertures in relationship to the image to be printed to thereby harmonize a printed image density in view of a desired image density.

Further variations of the method according to previously described enhancements are possible in view of the application of the invention.

The present invention satisfies a need for density harmonization not previously met.

The present invention relates to an image recording apparatus including an image receiving member conveyed past one or more, so called, print stations to intercept a modulated stream of toner particles from each print station. A print station includes a particle delivery unit, a particle source, such as a developer sleeve, and a printhead structure arranged between the particle source and the image receiving member. The printhead structure includes means for modulating the stream of toner particles from the particle source and means for controlling the trajectory of the modulated stream of toner particles toward the image receiving member.

According to a preferred embodiment of the present invention, the image recording apparatus comprises four print stations, each corresponding to a pigment colour, e.g. yellow, magenta, cyan, black (Y,M,C,K), disposed adjacent to an image receiving member formed of a seamless transfer belt made of a substantially uniformly thick, flexible material having high thermal resistance, high mechanical strength and stable electrical properties under a wide temperature range. The toner image is formed on the transfer belt and thereafter brought into contact with an information carrier, e.g. paper, in a fuser unit, where the toner image is simultaneously transferred to and made permanent on the information carrier upon heat and pressure. After image transfer, the transfer belt is brought in contact with a cleaning unit removing untransferred toner particles.

Other objects, features and advantages of the present inventions will become more apparent from the following description when read in conjunction with the accompanying drawings in which preferred embodiments of the invention are shown by way of illustrative examples.

BRIEF DESCRIPTION OF THE DRAWINGS

The invention will now be described in more detail for explanatory, and in no sense limiting, purposes, with reference to the following drawings, wherein like reference numerals designate like parts throughout and where the dimensions in the drawings are not to scale, in which.

DESCRIPTION OF PREFERRED EMBODIMENT

In order to clarify the method and device according to the invention, some examples of its use will now be described in connection with FIGS. 1 to 10.

Figure 1:
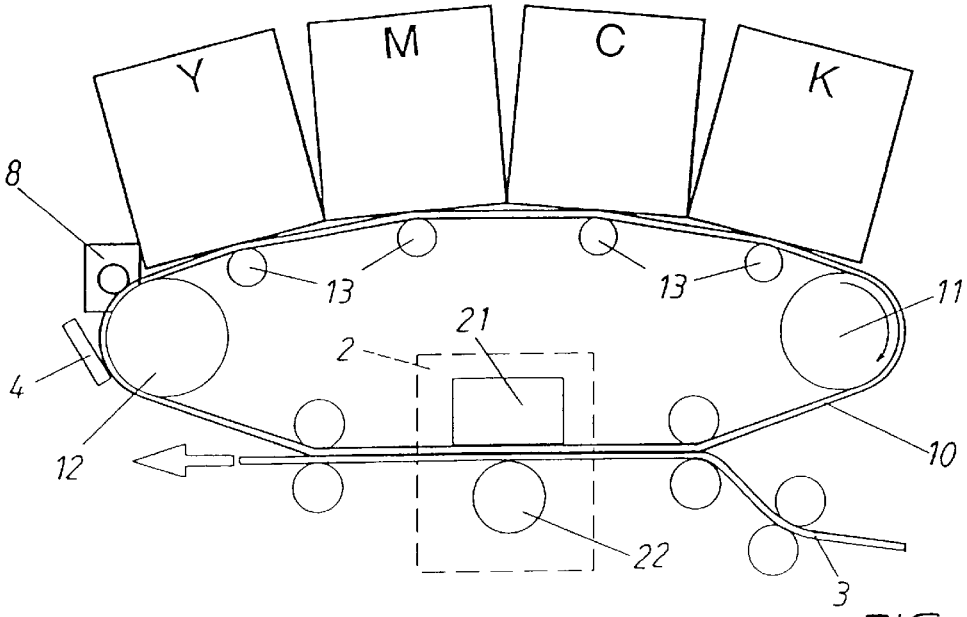
FIG. 1 is a schematic section view across an image recording apparatus according to a preferred embodiment of the invention.

FIG. 1 is a schematic section view of an image recording apparatus according to a first embodiment of the invention, comprising at least one print station, preferably four print stations (Y, M, C, K), an intermediate image receiving member, a driving roller 11, at least one support roller 12, and preferably several adjustable holding elements 13. The four print stations (Y, M, C, K) are arranged in relation to the intermediate image receiving member. The intermediate image receiving member, preferably a transfer belt 10, is mounted over the driving roller 11. The at least one support roller 12 is provided with a mechanism for maintaining the transfer belt 10 with at least a constant surface tension, while preventing transversal movement of the transfer belt 10. The preferably several adjustable holding elements 13 are for accurately positioning the transfer belt 10 at least with respect to each print station.

The driving roller 11 is preferably a cylindrical metallic sleeve having a rotational axis extending perpendicular to the belt motion and a rotation velocity adjusted to convey the transfer belt 10 at a velocity of one addressable dot location per print cycle, to provide line by line scan printing. The adjustable holding elements 13 are arranged for maintaining the surface of the transfer belt 10 at a predetermined distance from each print station. The holding elements 13 are preferably cylindrical sleeves disposed perpendicularly to the belt motion in an arcuated configuration for slightly bending the transfer belt 10 at least in the vicinity of each print station. The transfer belt 10 is slightly bent in order to, in combination with the belt tension, create a stabilization force component on the transfer belt 10. The stabilization force component is opposite in direction and preferably larger in magnitude than an electrostatic attraction force component acting on the transfer belt 10. The electrostatic attraction forces at a print station are created by induction charging of the belt and by different electric potentials on the holding elements 13 and on the print station in question.

The transfer belt 10 is preferably an endless band of 30 to 200 μm thick composite material as a base. The base composite material can suitably include thermoplastic polyamide resin or any other suitable material having a high thermal resistance, such as 260° C. of glass transition point and 388° C. of melting point, and stable mechanical properties under temperatures in the order of 250° C. The composite material of the tranfer belt 10 preferably has a homogeneous concentration of filler material, such as carbon or the like, which provides a uniform electrical conductivity throughout the entire surface of the transfer belt 10. The outer surface of the transfer belt 10 is preferably overlaid with a 5 to 30 μm thick coating layer made of electrically conductive polymere material such as for instance PTFE (poly tethra fluoro ethylene), PFA (tetra flouro ethylene, perflouro alkyl vinyl ether copolymer), FEP (tetra flouro ethylene hexaflouro, propylene copolymer), silicone, or any other suitable material having appropriate conductivity, thermal resistance, adhesion properties, release properties, and surface smoothness. To further improve for example the adhesion and release properties a layer of silicone oil can be applied to either the transfer belt base or preferably onto a coating layer if it is applied onto the transfer belt base. The silicone oil is coated evenly onto the transfer belt 10 preferably in the order of 0.1 to 2 μm thick giving a consumption of silicone oil in the region of 1 centiliter for every 1000 pages. Silicone oil also reduces bouncing/-scattering of toner particles upon reception of toner particles and also increases the subsequent transfer of toner particles to an information carrier. Making use of silicone oil and especially coating of the transfer belt with silicone oil is made possible in an electrostatic printing method according to the present invention as there is no direct physical contact between a toner delivery and a toner recipient, i.e. the transfer belt, in this embodiment.

In some embodiments the transfer belt 10 can comprise at least one separate image area and at least one of a cleaning area and/or a test area. The image area being intended for the deposition of toner particles, the cleaning area being intended for enabling the removal of unwanted toner particles from around each of the print stations, and the test area being intended for receiving test patterns of toner particles for calibration purposes. The transfer belt 10 can also in certain embodiments comprise a special registration area for use of determining the position of the transfer belt, especially an image area if available, in relation to each print station. If the transfer belt comprises a special registration area then this area is preferably at least spatially related to an image area.

The transfer belt 10 is conveyed past the four different print stations (Y, M, C, K), whereby toner particles are deposited on the outer surface of the transfer belt 10 and superposed to form a toner image. Toner images are then preferably conveyed through a fuser unit 2, comprising a fixing holder 21 arranged transversally in direct contact with the inner surface of the transfer belt. In some embodiments of the invention the fuser unit is separated from the transfer belt 10 and only acts on an information carrier. The fixing holder 21 includes a heating element preferably of a resistance type of e.g. molybdenium, maintained in contact with the inner surface of the transfer belt 10. As an electric current is passed through the heating element, the fixing holder 21 reaches a temperature required for melting the toner particles deposited on the outer surface of the transfer belt 10. The fuser unit 2 further comprises a pressing roller 22 arranged transversally across the width of the transfer belt 10 and facing the fixing holder 21. An information carrier 3, such as a sheet of plain, untreated paper or any other medium suitable for direct printing, is fed from a paper delivery unit (not shown) and conveyed between the pressing roller 22 and the transfer belt 10. The pressing roller 22 rotates with applied pressure to the heated surface of the fixing holder 21 whereby the melted toner particles are fused on the information carrier 3 to form a permanent image. After passage through the fusing unit 2, the transfer belt is brought in contact with a cleaning element 4, such as for example a replaceable scraper blade of fibrous material extending across the width of the transfer belt 10 for removing all untransferred toner particles. If the transfer belt 10 is to be coated with silicone oil or the like, then preferably after the cleaning element 4, and before the printing stations, the transfer belt 10 is brought into contact with a coating application element 8 for evenly coating the transfer belt with silicone oil or the like. In other embodiments toner particles are deposited directly onto an information carrier without first being deposited onto an intermediate image receiving member.

Figure 2:
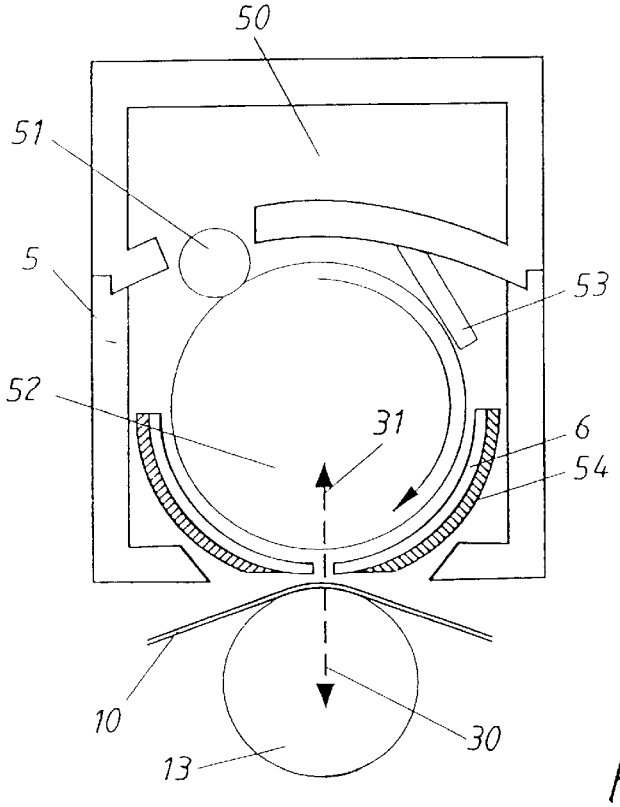
FIG. 2 is a schematic section view across a particular print station of the image recording apparatus shown in FIG. 1.

FIG. 2 is a schematic section view of one embodiment of a print station in, for example, the image recording apparatus shown in FIG. 1. A print station includes a particle delivery unit 5 preferably having a replaceable or refillable container 50 for holding toner particles, the container 50 having front and back walls, a pair of side walls and a bottom wall having an elongated opening extending from the front wall to the back wall and provided with a toner feeding element (not shown) disposed to continuously supply toner particles to a developer sleeve 52 through a particle charging member. The particle charging member can preferably be formed of a supply brush 51 or a roller made of or coated with a fibrous, resilient material. The supply brush 51 can suitably in some embodiments be brought into mechanical contact with the peripheral surface of the developer sleeve 52, for charging particles by contact charge exchange due to triboelectrification of the toner particles through frictional interaction between the fibrous material on the supply brush 51 and any suitable coating material of the developer sleeve 52. The developer sleeve 52 is preferably made of metal which can, for example, be coated with a conductive material, and preferably have a substantially cylindrical shape and a rotation axis extending parallel to the elongated opening of the particle container 50. Charged toner particles are held to the surface of the developer sleeve 52 by electrostatic forces essentially proportional to $(Q/D)^2$, where Q is the particle charge and D is the distance between the particle charge center and the boundary of the developer sleeve 52. Alternatively, the charging unit may additionally comprise a charging voltage source (not shown), which supply an electric field to induce or inject charge to the toner particles. Although it is preferred to charge particles through contact charge exchange, the method can be performed by using any other suitable charge unit, such as a conventional charge injection unit, a charge induction unit or a corona charging unit, without departing from the scope of the present invention.

A metering element 53 is positioned proximate to the developer sleeve 52 to adjust the concentration of toner particles on the peripheral surface of the developer sleeve 52, to form a relatively thin, uniform particle layer thereon. In some embodiments the metering element 53 also suitably contributes to the charging of the toner particles. The metering element 53 may be formed of a flexible or rigid, insulating or metallic blade, roller or any other member suitable for providing a uniform particle layer thickness. The metering element 53 may also be connected to a metering voltage source (not shown) which influence the triboelectrification of the particle layer to ensure a uniform particle charge distribution and mass density on the surface of the developer sleeve 52.

The developer sleeve 52 is arranged in relation with a support device 54 for supporting and maintaining the printhead structure 6 in a predetermined position with respect to the peripheral surface of the developer sleeve 52. The support device 54 is preferably in the form of a trough-shaped frame having two side walls, a bottom portion between the side walls, and an elongated slot arranged through the bottom portion, extending transversally across the print station, parallel to the rotation axis of the developer sleeve 52. The support device 54 further comprises means for maintaining the printhead structure in contact with the bottom portion of the support device 54, the printhead structure 6 thereby bridging the elongated slot in the bottom portion.

The transfer belt 10 is preferably slightly bent partly around each holding element 13 in order to create a stabilization force component 30. The stabilization force component 30 is intended to counteract, among other things, a field force component 31 which is acting on the transfer belt. If the field force component 31 is not counteracted it can cause distance fluctuations between the transfer belt 10 and the printhead structure 6 which can cause a degradation in print quality.

Figure 3:
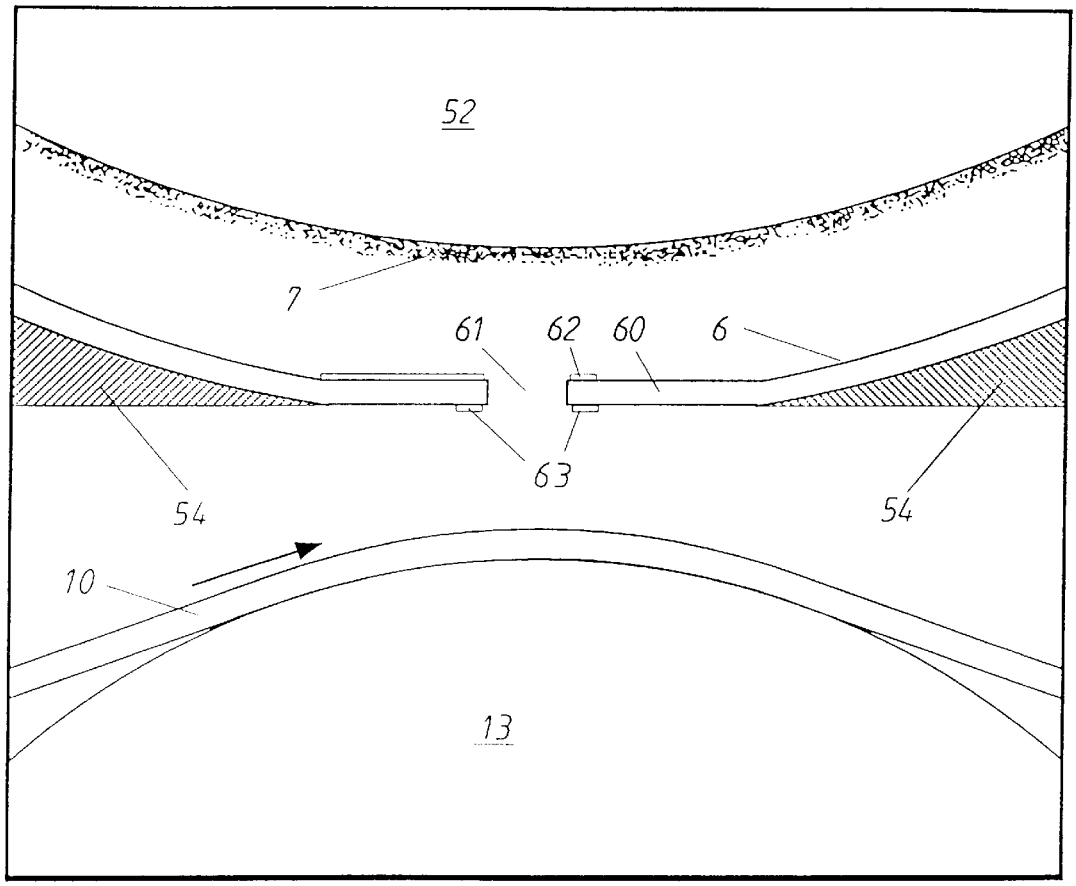
FIG. 3 is an enlargement of FIG. 2 showing the print zone corresponding to a particular print station.

FIG. 3 is an enlargement of the print zone in a print station of, for example, the image recording apparatus shown in FIG. 1. A printhead structure 6 is preferably formed of an electrically insulating substrate layer 60 made of flexible, non-rigid material such as polyamide or the like. The printhead structure 6 is positioned between a peripheral surface of a developer sleeve 52 and a bottom portion of a support device 54. The substrate layer 60 has a top surface facing a toner layer 7 on the peripheral surface of the developer sleeve 52. The substrate layer 60 has a bottom surface facing the bottom portion of the support device 54. Further, the substrate layer 60 has a plurality of apertures 61 arranged through the substrate layer 60 in a part of the substrate layer 60 overlying a elongated slot in the bottom portion of the support device 54. The printhead structure 6 further preferably includes a first printed circuit arranged on the top surface on the substrate layer 60 and a second printed circuit arranged on the bottom surface of the substrate layer 60. The first printed circuit includes a plurality of control electrodes 62, each of which, at least partially, surrounds a corresponding aperture 61 in the substrate layer 60. The second printed circuit preferably includes at least a first and a second set of deflection electrodes 63 spaced around first and second portions of the periphery of the apertures 61 of the substrate layer 60.

The apertures 61 and their surrounding area will under some circumstances need to be cleaned from toner particles which agglomerate there. In some embodiments of the invention the transfer belt 10 advantageously comprises at least one cleaning area for the purpose of cleaning the apertures 61 and the general area of the apertures 61. The cleaning, according to these embodiments, works by the principle of flowing air (or other gas). A pressure difference, compared to the air pressure in the vicinity of the apertures, is created on the side of the transfer belt 10 that is facing away from the apertures 61. The pressure difference is at least created during part of the time when the cleaning area is in the vicinity of the apertures 61 of the print station in question during the transfer belt's 10 movement. The pressure difference can either be an over pressure, a suction pressure or a sequential combination of both, i.e. the cleaning is performed by either blowing, suction, blowing first then suction, suction first then blowing, or some other sequential combination of suction and blowing. The pressure difference is transferred across the transfer belt 10 by means of the cleaning area comprising at least one slot/hole through the transfer belt 10. The cleaning area preferably comprises at least one row of slots, and more specifically two to eight interlaced rows of slots. The slots can advantageously be in the order of 3 to 5 mm across. The pressure difference appears on the holding element 13 side of the transfer belt 10 through a transfer passage in the holding element 13. The transfer passage can advantageously suitably extend transversally across the printhead structure as an elongated slot with a width, in the direction of the transfer belt 10 movement, that is equal to or greater than the minimum distance between the printhead structure 6 and the transfer belt 10. In some embodiments it can be advantageous to have a controllable passage which can open and close access of the pressure difference to the transfer passage. Thereby a suction pressure will not increase the transfer belt's friction on the holding element 13 more than necessary. The controllable passage will preferably open and close in synchronization with the movement of the transfer belt 10 to thereby coincide its openings with the passage of the cleaning area of the transfer belt 10. The means for creating the pressure difference is also not shown and can suitably be a fan, bellows, a piston, or some other suitable means for creating a pressure difference. In some embodiments according to the invention the transfer passage is substantially located symmetrically in relation to the apertures. In other embodiments according to the invention the transfer passage is shifted in relation to the direction of movement of the transfer belt 10.

Figure 4A:
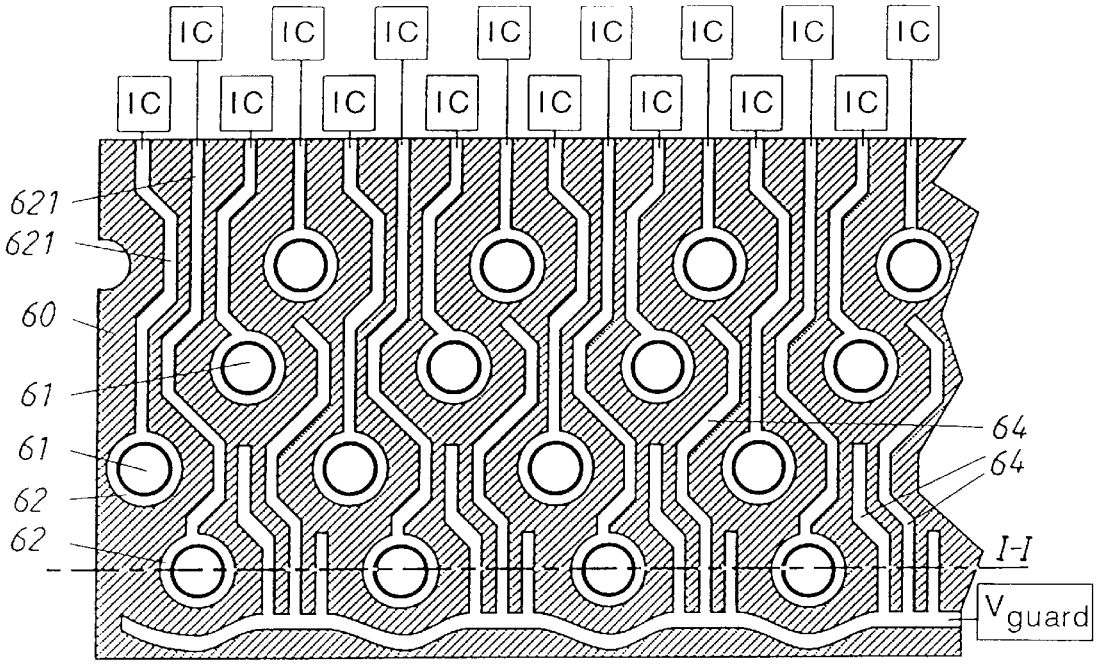
FIG. 4*a* is a schematic plan view of the top side of a printhead structure used in a print station such as that shown in FIG. 2.
Figure 4B:
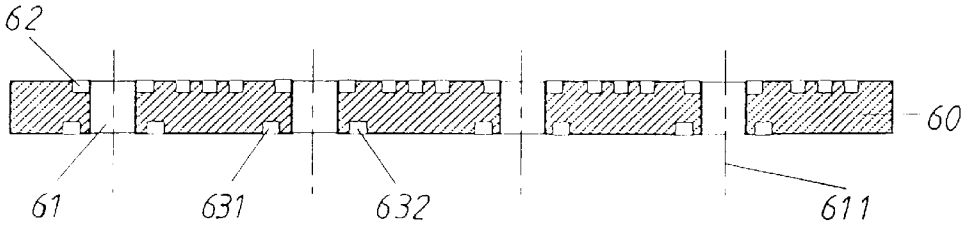
FIG. 4*b* is a schematic section view along the section line I—I through the printhead structure shown in FIG. 4*a*.
Figure 4C:
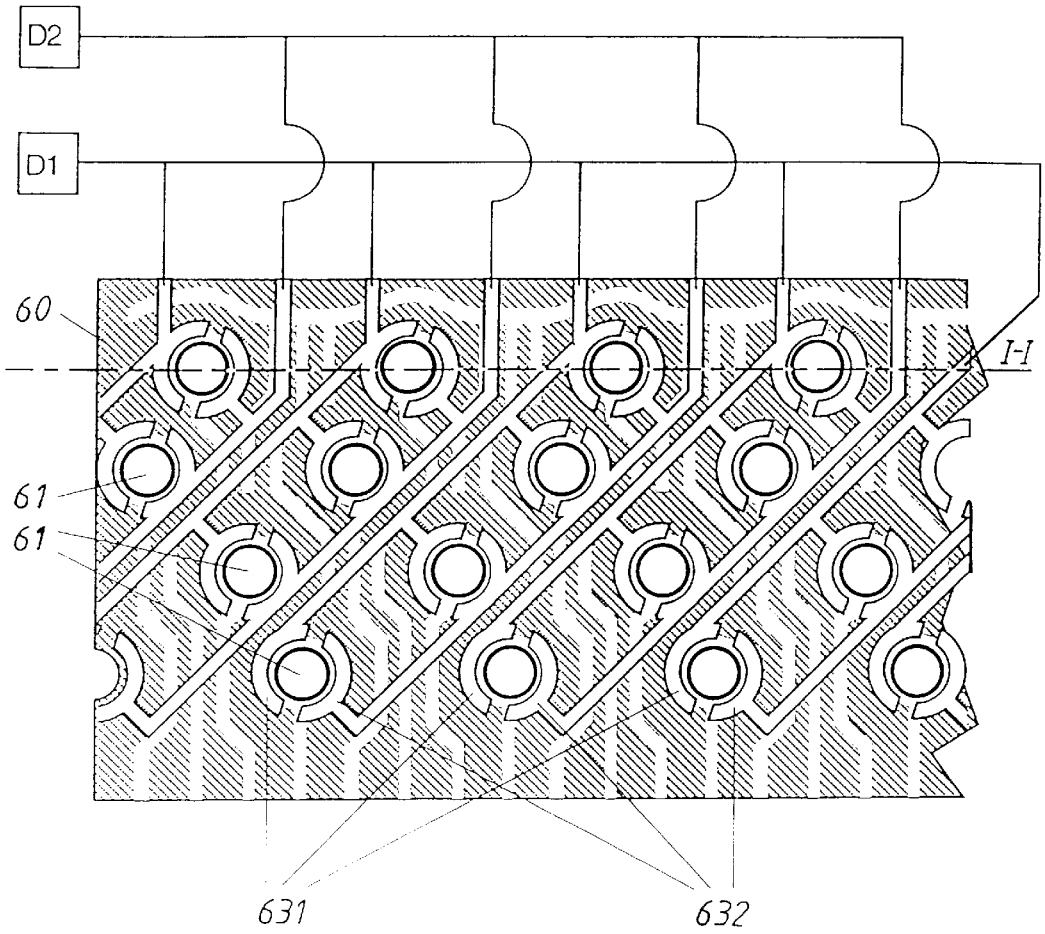
FIG. 4*c* is a schematic plan view of the bottom side of the printhead structure shown in FIG. 4*a*.

Although, a printhead structure 6 can take on various embodiments without departing from the scope of the present invention, a preferred embodiment of the printhead structure will be described hereinafter with reference to FIGS. 4*a,* 4*b* and 4*c*. A plurality of apertures 61 are arranged through the substrate layer 60 in several aperture rows extending transversally across the width of the print zone, preferably at a substantially right angle to the motion of the transfer belt. The apertures 61 preferably have a circular cross section with a central axis 611 extending perpendicularly to the substrate layer 60 and suitably a diameter in the order of 100 $\mu$m to 160 $\mu$m. Each aperture 61 is surrounded by a control electrode 62 having a ring-shaped part circumscribing the periphery of the aperture 61, with a symmetry axis coinciding with the central axis 611 of the aperture 61 and an inner diameter which is equal or sensibly larger than the aperture diameter. Each control electrode 62 is connected to a control voltage source (IC driver) through a connector 621. As apparent in FIG. 5*a,* the printhead structure further preferably includes guard electrodes 64, preferably arranged on the top surface of the substrate layer 60 and connected to a guard potential (Vguard) aimed to, among other things, decrease the influence on the toner layer and to electrically shield the control electrodes 62 from one another, thereby preventing undesired interaction between the electrostatic fields produced by two adjacent control electrodes 62. Each aperture 61 is related to a first deflection electrode 631 and a second deflection electrode 632 spaced around a first and a second segment of the periphery of the aperture 61, respectively. The deflection electrodes 631, 632 are preferably semicircular or crescent-shaped and disposed symmetrically on each side of a deflection axis extending diametrically across the aperture at a predetermined deflection angle to the motion of the transfer belt, such that the deflection electrodes substantially border on a first and a second half of the circumference of their corresponding aperture 61, respectively. All first and second deflection electrodes 631, 632 are connected to a first and a second deflection voltage source D1, D2, respectively.

As mentioned previously, different apertures behave differently. The apertures behave differently possibly partly due to the manufacturing of the printhead structure causing slightly different apertures to be made and possibly partly due to how the printhead structure is mounted. The centricity, size, and directivity of an aperture will influence its behaviour. The centricity of an aperture, i.e. how an aperture is centered in relation to its corresponding control electrode, will influence the amount of pigment particles the aperture will transport, given that other parameters are the same, because it will influence the efficiency of the control electrode. The size of an aperture will also vary the amount of transported pigment particles, given that other parameters are the same. These two irregularities will most probably be caused by irregularities in manufacturing while the directivity of an aperture, i.e. the directivity of an imagined center line through the aperture in relation to the pigment particle source and the back electrode, can be influenced by manufacturing and/or mounting. Other physical properties of the apertures and the printhead structure in general can of course also influence the behaviour of the apertures.

Figure 5A:
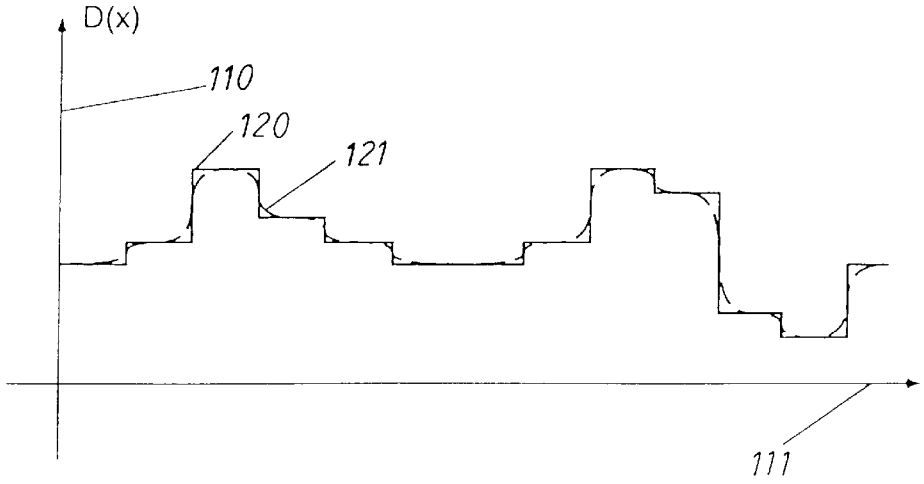
FIG. 5*a* illustrates a diagram of a measured or perceived density across the apertures.

The diagram according to FIG. 5*a,* where the Y-axis 110 indicates measured/perceived density D(x) for the same printed density and where the X-axis 111 indicates the distance across the printhead structure along the apertures, shows an example of how a printed density 120, 121 can vary due to the difference in behaviour of the individual apertures. FIG. 5*a* can equally well show the density distribution 120, 121 across a few apertures where the variations shown indicate individual apertures or FIG. 5*a* could show the density distribution 121 across the whole printhead structure along all the apertures.

The density distribution can be measured internally by measurement means between every printout, between a predetermined intervall of printouts, e.g. every thousand, on demand, or a suitable combination to thereby directly feed the control unit with the density distribution. The density can also, alternatively or in combination, be measured by external measurement means from a print sample, in which case the measured values have to be fed into the control unit by means of an I/O interface to the exterior. The characteristic, resolution, and accuracy of the measurement means will influence the measured density distribution and give different distributions.

Figure 5B:
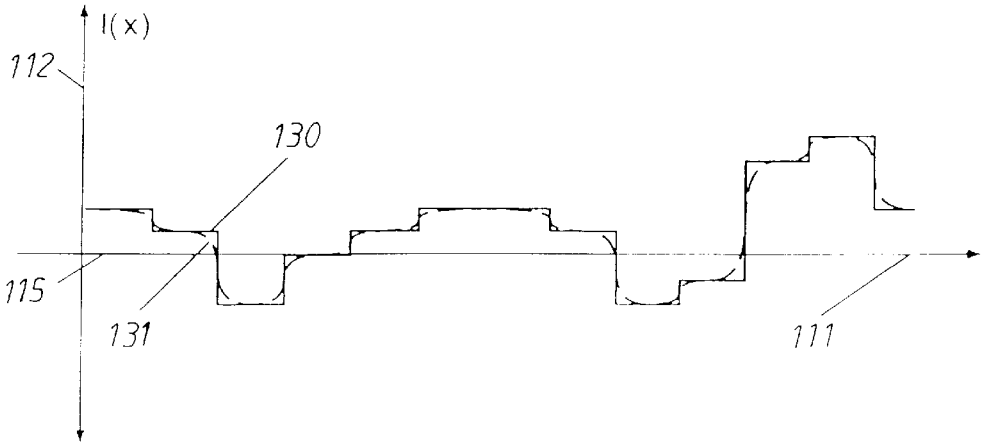
FIG. 5*b* illustrates a diagram of a compensation function.

According to one aspect of the invention, the measured density is utilized to create a compensation function. FIG. 5*b* shows a diagram of an example of a compensation function I(x) 130, 131 in view of a measured density according to FIG. 5*a*. The Y-axis 112 shows the level of the compensation function I(x) and the X-axis 111 indicates the distance across the printhead structure along the apertures. A zero level 115, or rather a level where no compensation is performed, will vary depending on the specific embodiment. According to one aspect of the invention the compensation function I(x) 130, 131 is an inverse function, i.e. a mirror image, of the measured density. This compensation is subsequently used to adjust the behaviour of individual or more apertures at a time. As mentioned previously, the characteristic, resolution, and accuracy of the measurement means influences the measured density and thus also the compensation, this is shown in the FIGS. 5*a* and 5*b* by the filled 120, 130 and dotted lines 121, 131. However, it can also in some embodiments be advantageous to low pass filter the output function of the measurement means or the compensation function to thereby smear out abrupt changes. Other types of signal processing on either or both functions can be done in dependence on the specific embodiment.

Depending on how the specific adjustment is made, in accordance with the compensation function, in dependence on the specific embodiment, only positive adjustments, only negative adjustment, or as shown in the figure, both positive and negative adjustments can be possible. The zero level 115, the uncompensated density level, denotes the desired density level and can of course vary. The adjustments can be made by changing the opening and closing times of individual apertures and/or by changing the voltage potentials of the control electrodes used during opening and closing. The adjustments will enable control, and thus harmonization, of the amount of toner/pigment particles transported through individual apertures during the opening times, thus enabling a harmonization of the perceived image density across the apertures for a predetermined desired image density.

As mentioned previously, an uneven supply of pigment particles to the apertures may arise. If different apertures have a different amount of pigment particles available, then the amount of toner/pigment particles transported, and thus printed density, through these apertures will be different for the same desired density. One possible reason for an uneven availability of pigment particles to different apertures can be that the apertures commonly are arranged in two or more rows.

Figure 6:
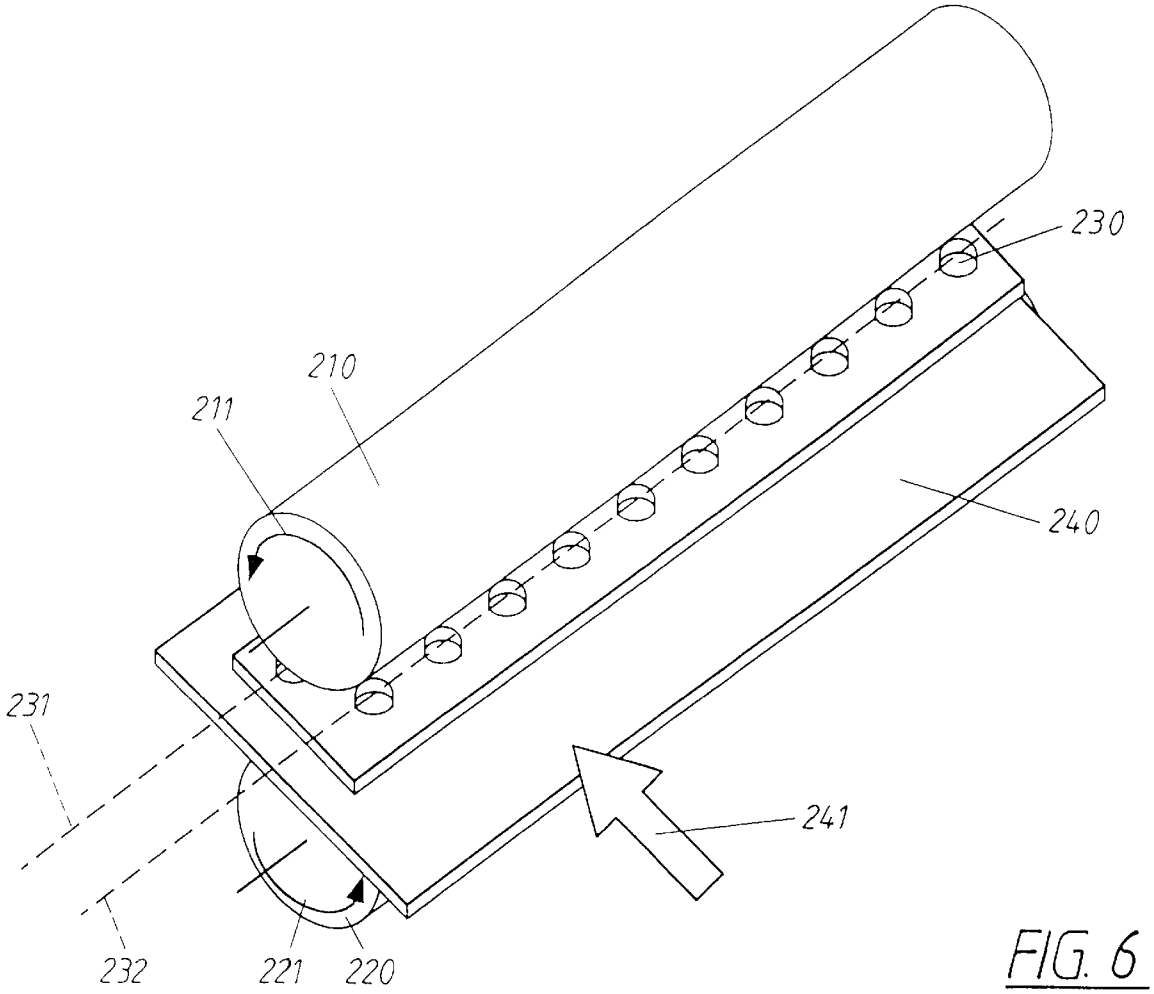
FIG. 6 is a schematic view of part of a printhead structure and a pigment particle source.

FIG. 6 shows a very rough schematic of a printhead structure with two rows 231, 232 of apertures 230, a pigment particle source 210 having a firs rotational direction 211, a back electrode 220 with a possible second rotational direction 221, and an image receiving member 240 such as an intermediate image receiving member, a transfer belt, or information carrier, having a directional movement 241.

The row 231 of apertures that the pigment particle source 210 reaches first, so to speak, will have a full nominal supply of pigment particles available. The second 232 and further rows will have less pigment particles available if there has been some printing done by the first row 231. This is because the pigment particle pick-up area of an aperture is somewhat larger than the aperture which causes the first row 231 of apertures to "steal" pigment particles from the second 232 and further rows' supply.

According to one aspect of the invention the control unit of the device will control the amount of pigment particles delivered through the apertures. In one embodiment the control unit controls the control electrodes of the apertures so that the apertures of the first row will pull pigment particles for a shorter period of time or at a lesser rate than the apertures of the second and further rows will for the same desired density. The control unit accomplishes this by changing the opening and closing times of the apertures, changing the voltage potentials of the control electrodes during opening and closing, and/or by changing the electrical field created by i.a. the back electrode for the transportation of pigment particles.

In another embodiment, alone or in combination with previously described features, the control unit controls the control electrodes of the apertures such that when a feature having an edge with the same density as the feature as a whole, i.e. there is a density change in relation to the surroundings, is to be printed, the dots printed on the edge receive mainly the same amount of pigment particles as the dots printed within the feature. A feature will means a change in density from high to low and from low to high or from low to high and from high to low depending on the density of the feature and the density of the surroundings. Thus, there will be a change in the consumption and therefore also the amount of available pigment particles and this will vary from the edge of a feature to a steady state within the feature. To harmonize the perceived density of the feature the control unit will control the control electrodes of the apertures such that all the dots of the feature with the same desired dot density mainly receive the same amount of pigment particles. This is accomplished by letting apertures, when the apertures prints dots of an edge of a feature, pull pigment particles for a shorter period of time or at a lesser rate than when the apertures prints dots within the feature or vice versa in dependence on the desired density of the feature and the desired density of the surroundings. The control unit accomplishes this by changing the opening and closing times of the apertures and/or by changing the voltage potentials of the control electrodes during opening and closing.

According to one aspect of the invention the control unit of the device will continuously keep track of the amount of pigment particles each aperture has available to thereby be able to control the amount of pigment particles that are fed through the apertures. By being able to control the amount of pigment particles that a fed through the apertures, a high degree of accuracy is possible of the attained printed density. By knowing the pick-up area of each aperture, the renewal rate of pigment particles, and the past history, i.e. has there been much black printed leaving very little toner left or has no printing been done meaning that there is plenty of pigment particles, the control unit can according to one aspect of the invention determine the amount of pigment particles that individual or possibly group of apertures have available for printing. According to the one aspect of the invention this information is used by the control unit to control the control electrodes such that an appropriate amount of pigment particles are transported through an aperture in question to thereby a desired printed density. If only a small amount of pigment particles are available then the aperture has pull pigment particles harder and/or longer than if a large amount of pigment particles are available. The control unit accomplishes this according to this aspect of the invention by either changing the opening and closing times of the aperture and/or by changing the control voltages of the control electrode of the aperture during opening and closing.

Figure 7:
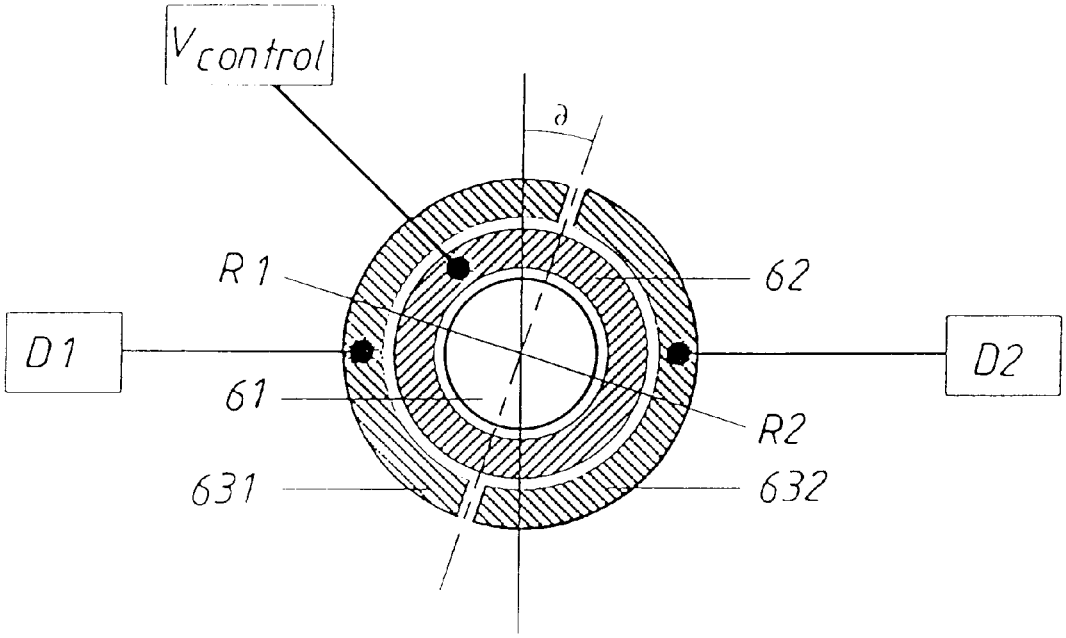
FIG. 7 is a schematic view of a single aperture and its corresponding control electrode and deflection electrodes.

FIG. 7 is a schematic view of a single aperture 61 and its corresponding control electrode 62 and deflection electrodes 631, 632. Toner particles are deflected in a first deflection direction R1 when D1<D2, and an opposite direction R2 when D1>D2. The deflection angle δ is chosen to compensate for the motion of the transfer belt 10 during the print cycle, in order to be able to obtain two or more transversally aligned dots.

Figure 8A:
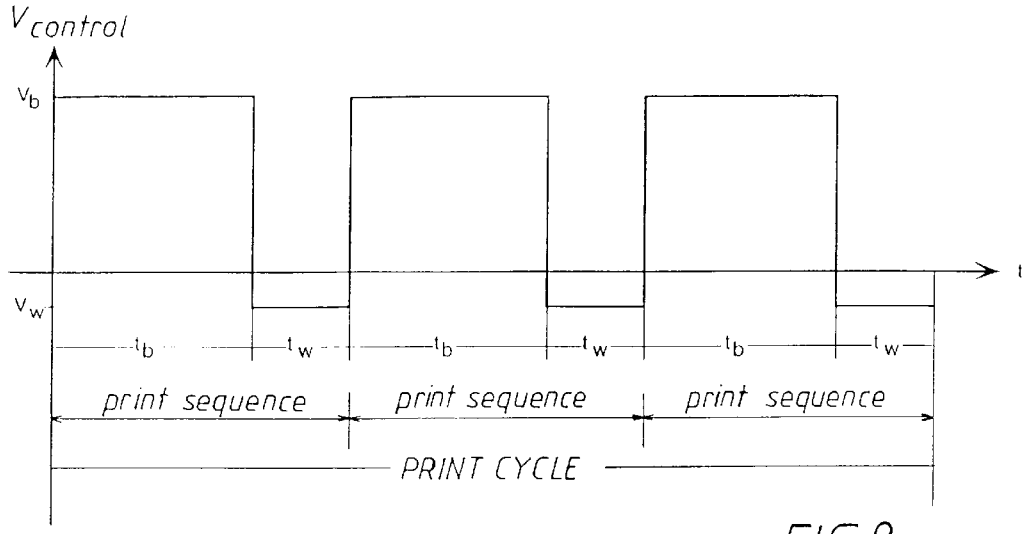
FIG. 8*a* illustrates a control voltage signal as a function of time during a print cycle having three subsequent development periods.

A preferred embodiment of a dot deflection control function is illustrated in FIGS. 8*a,* 8*b* and 8*c* respectively showing the control voltage signal ($V_{control}$), a first deflection voltage D1 and a second deflection voltage D2, as a function of time during a single print cycle. According to some embodiments of the invention and as illustrated in the figure, printing is performed in print cycles having three subsequent print sequences with corresponding development periods for addressing three different dot locations through each aperture. In other embodiments each print cycle can suitably have fewer or more addressable dot locations for each aperture. In still further embodiments each print cycle has a controllable number of addressable dot locations for each aperture. During the whole print cycle an electric background field is produced between a first potential on the surface of the developer sleeve and a second potential on the back electrode, to enable the transport of toner particles between the developer sleeve and the transfer belt. During each development period, control voltages are applied to the control electrodes to produce a pattern of electrostatic control fields which due to control in accordance with the image information, selectively open or close the apertures by influencing the electric background field, thereby enhancing or inhibiting the transport of toner through the printhead structure. The toner particles allowed to pass through the opened apertures are then transported toward their intended dot location along a trajectory which is determined by the deflection mode.

The examples of control function shown in FIGS. 8*a,* 8*b* and 8*c* illustrates a control function wherein the toner particles have negative polarity change. As is apparent from FIG. 8*a,* a print cycle comprises three development periods $t_b$, each followed by a recovering period $t_w$ during which new toner is supplied to the print zone. The control voltage pulse ($V_{control}$) can be amplitude and/or pulse width modulated, to allow the intended amount of toner particles to be transported through the aperture. For instance, the amplitude of the control voltage varies between a non-print level $V_w$ of approximately −50V and a print level $V_b$ in the order of +350V, corresponding to full density dots. Similarly, the pulse width can be varied from 0 to $t_b$.

The control of the position of a dot location can be increased to thereby enable an apparent increase of the print resolution. A method of achieving this is to individually control the timing of each developer period, i.e. individually control the timing of the opening and closing of the apertures. By individually controlling the timing for each developer period for each aperture, each dot location can be repositioned in a direction which is mainly parallell to the direction of travel of the image receiving member, information carrier, or transfer belt. Thus individual dot positions can be moved/adjusted forward or backward, i.e. in a direction parallell to the direction of travel of the information carrier, by time displacing the opening and closing of the apertures.

Figure 8B:
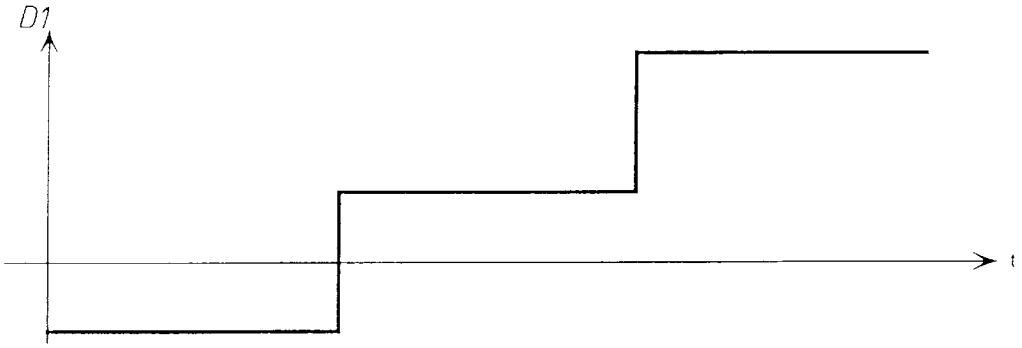
FIG. 8*b* illustrates a first deflection voltage signal as a function of time during a print cycle having three subsequent development periods
Figure 8C:
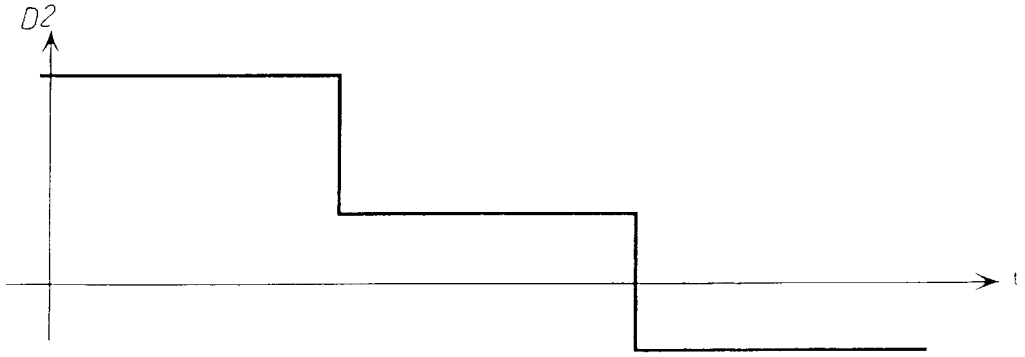
FIG. 8*c* illustrates a second deflection voltage signal as a function of time during a print cycle having three subsequent development periods

As apparent from FIGS. 8*b* and 8*c,* the amplitude difference between D1 and D2 is sequentially modified for providing three different toner trajectories, i.e. dot positions, during each print cycle. The amplitudes of D1 and D2 are modulated to apply converging forces on the toner to obtain smaller dots. Utilizing this method enables, for example, 60 μm dots to be obtained utilizing 160 μm apertures. Suitably the size of the dots are adjusted in accordance with the dot density (dpi) and thus also dynamically with the number of dot locations each apertures is to address.

An additional, or another, method/part method of increasing the apparent print resolution is to control the size of the individual dots not only in view of the dot density but also according to the image which is to be printed. Thus by being able to increase or decrease the size of individual dots, in dependence upon the image which is to be printed, especially edges can be improved, giving an improved image print quality. This can be used on its own or in combination with the improved dot location control.

Figure 9A:
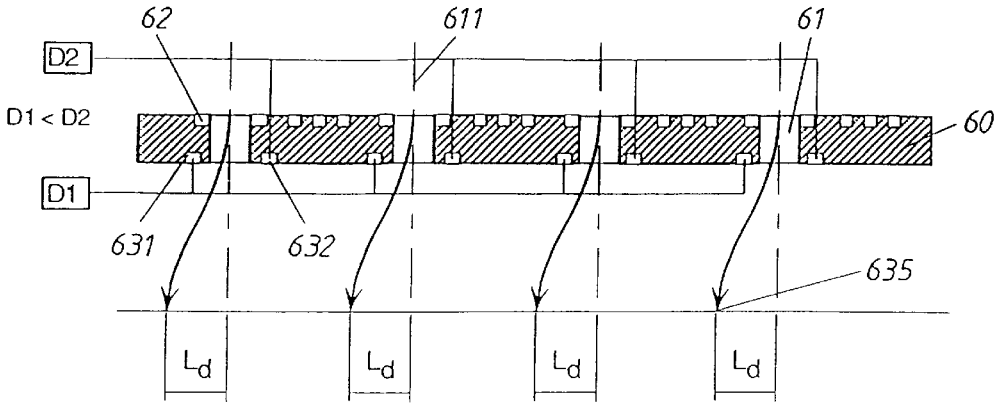
FIG. 9*a* illustrates the transport trajectory of toner particles through the printhead structure shown in FIGS. 4*a,b,c* according to a first deflection mode wherein D1>D2.
Figure 9B:
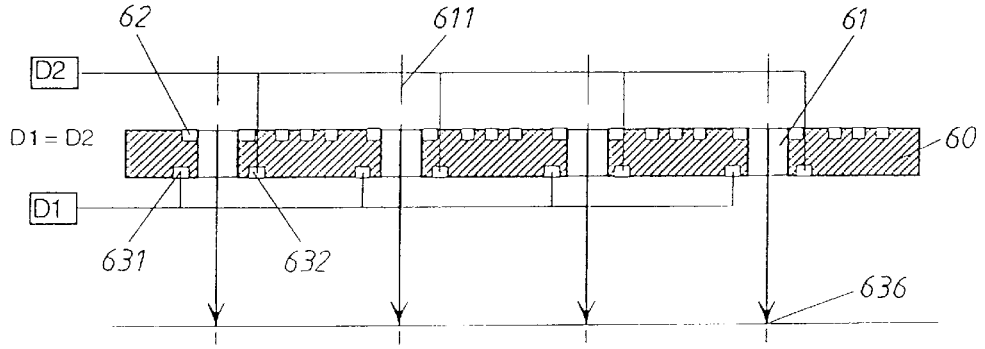
FIG. 9*b* illustrates the transport trajectory of toner particles through the printhead structure shown in FIGS. 4*a,b,c,* according to a second deflection mode wherein D1=D2.
Figure 9C:
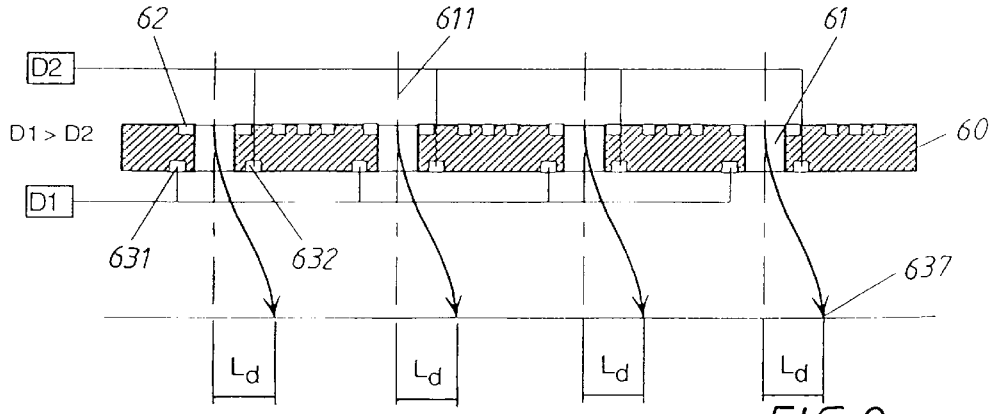
FIG. 9*c* illustrates the transport trajectory of toner particles through the printhead structure shown in FIGS. 4*a,b,c,* according to a third deflection mode wherein D1<D2.

FIGS. 9*a,* 9*b* and 9*c* illustrate the toner trajectories in three subsequent deflection modes. The FIGS. 9*a,* 9*b* and 9*c* illustrate a cross section of a substrate layer 60 with apertures 61 with corresponding control electrodes 62. Also illustrated are deflection voltages D1 and D2 that are connected to respective deflection electrodes 631, 632. During a first development period illustrated in FIG. 9*a,* the modulated stream of toner particles is deflected to the left by producing a first amplitude difference (D1>D2) between both deflection voltages. The amplitude difference is adjusted to address dot locations 635 located at a deflection length $L_d$ to the left of the central axis 611 of the apertures 61. During a second development period illustrated in FIG. 9*b,* the deflection voltages have equal amplitudes (D1=D2) to address undeflected dot locations 636 coinciding with the central axes 611 of the apertures 61. During a third development period illustrated in FIG. 9*c,* the modulated stream of toner particles is deflected to the right by producing a second amplitude difference (D1<D2) between both deflection voltages. The amplitude difference is adjusted to address dot locations 637 located at a deflection length $L_d$ to the right of the central axes 611 of the apertures 61. As is apparent from the FIGS. 9*a–c,* the toner particles in question are negatively charged.

The control of the position of a dot location can be increased to thereby enable an apparent increase of the print resolution. A method of achieving this is to divide a print sequence into different parts with different deflection voltages by time multiplexing, i.e. during a first part time dots with normal deflection are printed and during a second or more part time(s) dots with a modified deflection are printed. Another method of achieving this is to individually control the deflection of each print sequence, i.e. individually control the deflection voltages D1 and D2 of the deflection electrodes of each aperture to thereby individually adjust $L_d$ and possibly introduce a deflection of a center dot. By individually controlling the deflection voltages during each print sequence for each aperture, each dot location can be repositioned in a direction which is mainly perpendicular to the direction of travel of the image receiving member, information carrier, or transfer belt. Thus individual dot positions can be moved/adjusted leftward or rightward, i.e. in a direction perpendicular to the direction of travel of the information carrier, by adjusting the deflection voltages of the apertures.

Figure 10:
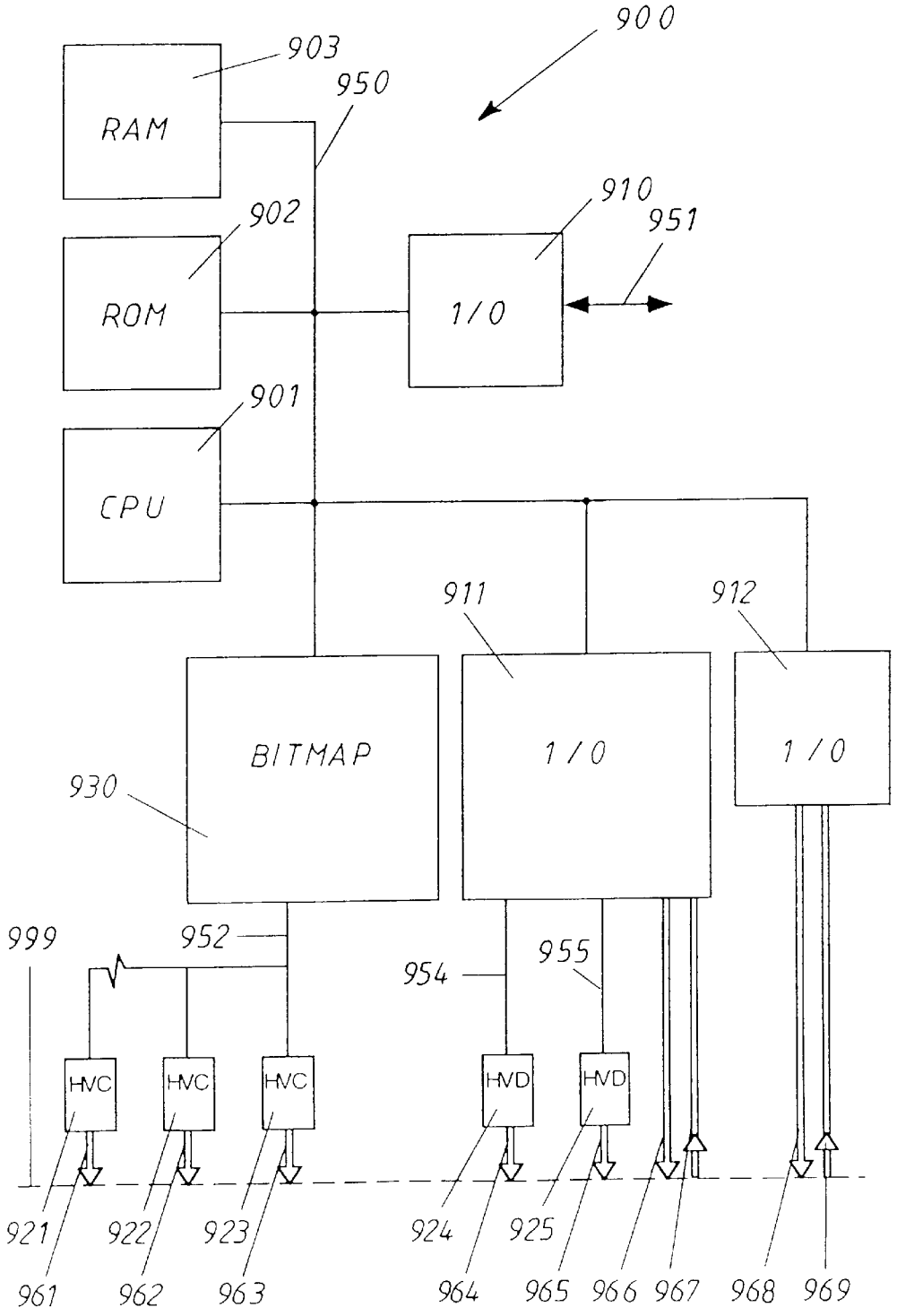
FIG. 10 illustrates a control unit.

The control functions of a printer according to the invention is handled by a control unit which is schematically illustrated in FIG. 10. The illustration of the control unit 900 is merely to give an example of one possible embodiment of the control unit 900. All the different parts may be separate as illustrated or more or less integrated. The memories 902, 903, 930 may be of an arbitrary type which will suit the embodiment in question. The control unit 900 comprises a computing part which comprises a CPU 901, program memory ROM 902, working memory RAM 903, a user I/O interface 910 through which a user will communicate 951 with the printer for downloading of commands and images to be printed, and a bus system 950 for interconnection and communication between the different parts of the control unit 900. The control unit 900 also suitably comprises a bitmap 930 for storage of the image to be printed and one or more I/O interfaces 911, 912 for control and monitoring of the printer. Further, if necessary, one or more power—high voltage drivers 921, 922, 923, 924, 925 are connected to the hardware of the printer illustrated by an interface line 999.

The one or more I/O interfaces 911, 912 for control and monitoring of the printer can logically be divided into one simple I/O interface 912 for on/off control and monitoring and one advanced I/O interface 911 for multilevel control and monitoring, speed control, and analog measurements. Typically the simple I/O interface 912 handles keyboard input 969 and feedback output 968, control of simple motors and indicators, monitoring of different switches and other feedback means. Typically the advanced I/O interface 911 will control 954, 955 the deflection voltages 964 and guard voltages 965 via high voltage drivers 924, 925. The advanced I/O interface 911 will typically also speed control 966 one or more motors with a control loop feedback 967.

A user, e.g. a personal computer, will download, through the user I/O interface 910, commands and images 951 to be printed. The CPU 901 will interpret the commands under control of its programs and typically load the images to be printed into the bitmap 930. The bitmap 930 will preferably comprise at least two logical bitmaps, one which can be printed from and one which can be used for download of the next image to be printed. The functions of the preferably at least two logical bitmaps will continuously switch when their previous function is finished.

In a preferred embodiment the bitmap 930 will serially 952 load a plurality of high voltage drive controllers 921, 922, 923 with the image information to be printed. The number of high voltage drive controllers 921, 922, 923 that are necessary will, for example, depend on the resolution and the number of apertures, i.e. control electrodes, each controller 921, 922, 923 will handle. The high voltage drive controllers 921, 922, 923 will convert the image information they receive to signals 961, 962, 963 with the proper voltage levels required by the control electrodes of the printer.

Figure 11:
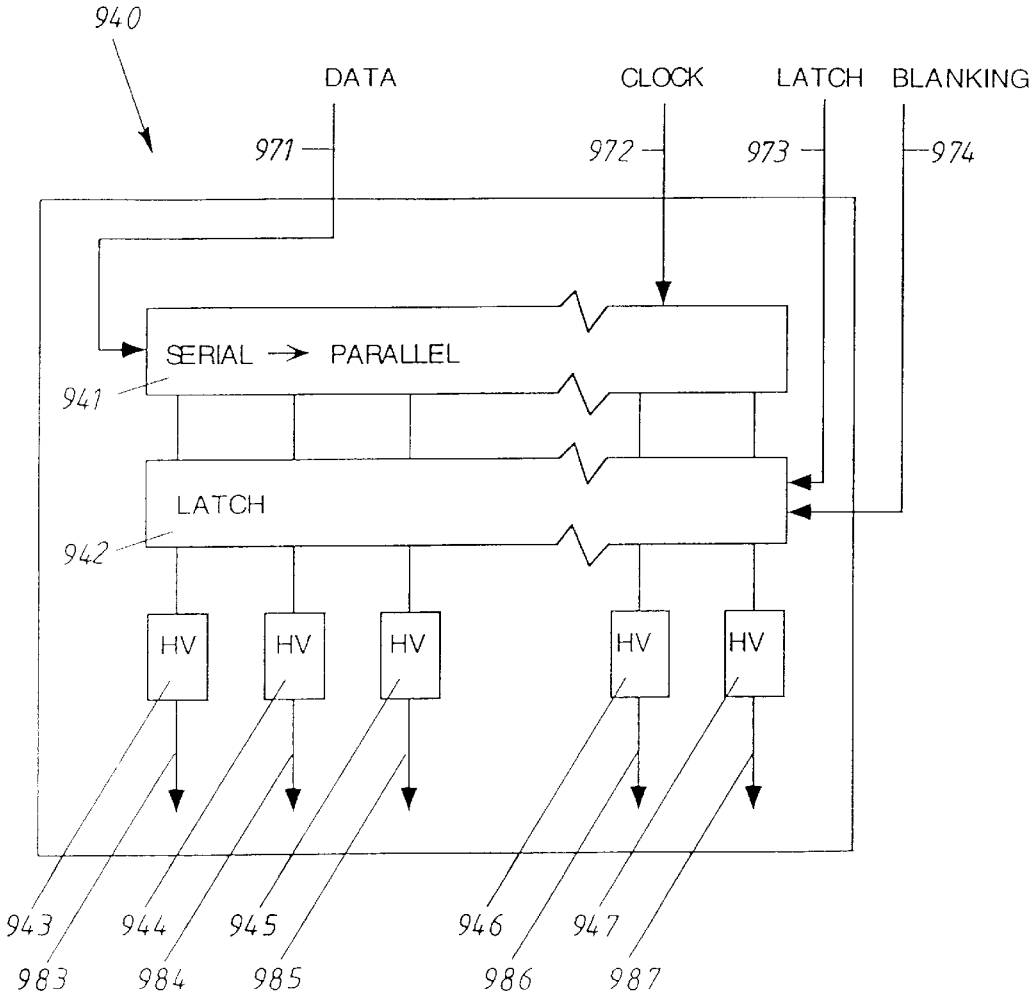
FIG. 11 illustrates a high voltage control electrode driver.

FIG. 11 illustrates one possible schematic of a high voltage drive controller 940. The image information is received serially via a data input 971. The image information is clocked 972 into a serial to parallel register 941. When the serial to parallel register 941 is full the image information is latched 973 into a latch 942 at an appropriate time, thus enabling new image information to be clocked into the serial to parallel register. The controller preferably comprises high voltage drivers 943, 944, 945, 946, 947 for conversion of the image data in the latch to signals 983, 984, 985, 986, 987 with the appropriate voltage levels required by the control electrodes of the apertures. The high voltage drive controller can also suitably comprise a blanking input 974 to enable a higher degree of control of the outputs 983, 984, 985, 986, 987 to the control electrodes.

The invention is not limited to the embodiments described above but may be varied within the scope of the appended patent claims.

What is claimed is:

1. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member;

wherein:

the image receiving member and the printhead structure move relative to each other during printing;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles to thereby enable the formation of a pigment image on the first face of the image receiving member; and the control unit controls the control electrodes of the apertures in view of an available amount of pigment particles to the apertures in relationship to the image to be printed to thereby harmonize a printed image density in view of a desired image density.

2. A direct electrostatic printing device according to claim 1, wherein the control unit controls the control electrodes of the apertures in view of an available amount of pigment particles to the apertures in relationship to the image to be printed to thereby harmonize a printed dot density of a dot to be printed on an edge of a density variation feature in relation to a printed dot density of a dot to be printed within the feature, both with a same desired dot density.

3. A direct electrostatic printing device according to claim 1, wherein the control unit controls a voltage potential of the control electrodes of the apertures, during the selective opening and closing of the apertures, such that, for the same desired dot density, an amount of delivered pigment particles when printing a dot when the available amount of pigment particles for the aperture in question is low, is mainly the same as when printing a dot when the available amount of pigment particles for the aperture in question is high.

4. A direct electrostatic printing device according to claim 1, wherein the control unit controls the control electrodes of the apertures such that an amount of pigment particles delivered to a dot on an edge of a feature is mainly the same as an amount of pigment particles delivered to a dot, with the same desired dot density, within the feature.

5. A direct electrostatic printing device according to claim 1, wherein the printhead structure includes deflection electrodes connected to the control unit for controlling the deflection of pigment particles in transport to thereby be able to deflect pigment particles against predetermined location son the first face of the image receiving member in view of the image which is to be printed by means of predetermined deflection voltages.

6. A direct electrostatic printing device according to claim 1, wherein the image receiving member is an information carrier.

7. A direct electrostatic printing device according to claim 1, wherein the image receiving member is a transfer belt comprised in the direct electrostatic printing device where the transfer belt is positioned at a predetermined distance from the printhead structure, the transfer belt being substantially of uniform thickness, whereby a pigment image is subsequently transferred to an information carrier.

8. A direct electrostatic printing device according to claim 7, wherein the transfer belt is supported by at least one holding element arranged on the side of the second face of the transfer belt adjacent to the print station.

9. A direct electrostatic printing device according to claim 7, wherein the first face of the image receiving member, the transfer belt, is substantially evenly coated with a layer of bouncing reduction agent thus providing a surface on the first face of the image receiving member to which the pigment particles transported through the print head structure substantially adhere substantially without bouncing.

10. A direct electrostatic printing device according to claim 7, wherein the image printing device further comprises a transfuser having heating means and pressurizing means for transferring a pigment image on the surface of the first face of the image receiving member to an information carrier by locally applying heat and pressure to the information carrier and the pigment image by the heating means and the pressurizing means and thereby transferring the pigment image to the information carrier.

11. A direct electrostatic printing device according to claim 1, wherein the image printing device is capable of printing color images and includes four pigment particle sources.

12. A direct electrostatic printing device according to claim 1, wherein the printing device includes at least two pigment particle sources with corresponding control electrodes on and apertures in at least one printhead structure.

13. A direct electrostatic printing device according to claim 1, wherein the image printing device includes four pigment particle sources with corresponding control electrodes on and apertures in at least one printhead structure.

14. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member;

wherein:

the image receiving member and the printhead structure move relative to each other during printing;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles to thereby enable the formation of a pigment image on the first face of the image receiving member; and the control unit controls the control electrodes of the apertures in view of an available amount of pigment particles to the apertures in relationship to the image to be printed to thereby harmonize a printed image density in view of a desired image density, wherein the control unit determines the amount of available pigment particles by continuously updating a register for each aperture or a group of apertures, by subtraction of pigment particle usage form a refill rate of pigment particles.

15. A direct electrostatic printing device according to claim 14, wherein the control unit determines the amount of available pigment particles in relation to the pigment particle pickup area from the pigment particle source for each aperture or group of apertures.

16. A direct electrostatic printing device comprising:

a pigment particle source, which provides pigment particles;

a voltage source;

a control unit;

a printhead structure having a plurality of apertures through the printhead structure having control electrodes proximate to the apertures, the control electrodes being coupled to the control unit;

a back electrode; and an image receiving member;

wherein:

the image receiving member and the printhead structure move relative to each other during printing;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles form the pigment particle source toward the first face of the image receiving member;

the control electrodes of the printhead structure are responsive to the control unit to thereby selectively open or close the apertures through the printhead structure to permit or restrict the transport of pigment particles to thereby enable the formation of a pigment image on the first face of the image receiving member; and the control unit controls the control electrodes of the apertures in view of an available amount of pigment particles to the apertures in relationship to the image to be printed to thereby harmonize a printed image density in view of a desired image density, wherein the control unit controls the selective opening and closing of the apertures such that, for the same desired dot density, the opening time is longer when printing a dot when the available amount of pigment particles for the aperture in question is low, than when printing a dot when the available amount of pigment particles for the aperture in question is high.

17. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member;

wherein:

the image receiving member and the printhead structure move relative to each other during printing;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles form the pigment particle source toward the first face of the image receiving member;

the control electrodes of the printhead structure are responsive to the control unit to thereby selectively open or close the apertures through the printhead structure to permit or restrict the transport of pigment particles to thereby enable the formation of a pigment image on the first face of the image receiving member; and the control unit controls the control electrodes of the apertures in view of an available amount of pigment particles to the apertures in relationship to the image to be printed to thereby harmonize a printed image density in view of a desired image density, wherein the control unit in combination controls the selective length of opening of the apertures and a voltage potential of the control electrodes of the apertures during the selective opening such that, for the same desired dot density, the opening time and voltage potential of the control electrodes is adjusted in such a way that an amount of delivered pigment particles when printing a dot when the available amount of pigment particles for the aperture in question is low, is mainly the same as when printing a dot when the available amount of pigment particles for the aperture in question is high.

18. A method for printing an image to an information carrier, wherein the method comprises:

providing pigment particles from a pigment particle source;

moving an image receiving member and a printhead structure relative to each other during printing;

creating an electrical field for transporting pigment particles from the pigment particle source toward a first face of the image receiving member;

selectively opening or closing apertures through the printhead structure to permit or restrict the transporting of pigment particles to thereby enable the formation of a pigment image on the first face of the image receiving member; and controlling control electrodes of the apertures in view of an available amount of pigment particles to the apertures in relationship to the image to be printed to thereby harmonize a printed image density in view of a desired image density.

* * * * *

UNITED STATES PATENT AND TRADEMARK OFFICE
CERTIFICATE OF CORRECTION

PATENT NO. : 6,102,525

DATED : August 15, 2000

INVENTOR : Tomas Jonsson

It is certified that error appears in the above-identified patent and that said Letters Patent is hereby corrected as shown below:

In column 21 at line 64, change "usage form" to --usage from--.

In column 22 at line 10, change "structure having" to --structure and having--.

In column 22 at line 25, change "particles form" to --particles from--.

In column 23 at line 1, change "particles form" to --particles from--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*